US008726725B2

(12) United States Patent
Nguyen-Thuyet et al.

(10) Patent No.: US 8,726,725 B2
(45) Date of Patent: May 20, 2014

(54) APPARATUS, SYSTEM AND METHOD FOR DETERMINING AT LEAST ONE DOWNHOLE PARAMETER OF A WELLSITE

(75) Inventors: Alain Nguyen-Thuyet, Paris (FR); Pierre-Marie Petit, Saint-Thibault des Vignes (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 349 days.

(21) Appl. No.: 13/309,581

(22) Filed: Dec. 2, 2011

(65) Prior Publication Data

US 2012/0227480 A1 Sep. 13, 2012

Related U.S. Application Data

(60) Provisional application No. 61/450,168, filed on Mar. 8, 2011.

(51) Int. Cl.
*E21B 47/06* (2012.01)
*G01L 11/00* (2006.01)

(52) U.S. Cl.
USPC ..... 73/152.51; 73/702

(58) Field of Classification Search
USPC ..... 73/152.51, 152.52, 702
See application file for complete search history.

(56) References Cited

U.S. PATENT DOCUMENTS

| | | | |
|---|---|---|---|
| 3,617,780 | A | 11/1971 | Benjaminson et al. |
| 4,407,136 | A | 10/1983 | de Kanter |
| 4,547,691 | A | 10/1985 | Valdois et al. |
| 4,547,692 | A | 10/1985 | Spaulding |
| 4,607,530 | A | 8/1986 | Chow |
| 4,802,370 | A | 2/1989 | EerNisse et al. |
| 4,936,147 | A | 6/1990 | EerNisse et al. |
| 5,221,873 | A | 6/1993 | Totty et al. |
| 5,265,677 | A | 11/1993 | Schultz |
| 5,302,879 | A | 4/1994 | Totty et al. |

(Continued)

FOREIGN PATENT DOCUMENTS

| | | |
|---|---|---|
| EP | 552884 | 7/1997 |
| WO | 02/037072 | 5/2002 |
| WO | 2006/060673 | 6/2006 |
| WO | 2006/065559 | 6/2006 |

OTHER PUBLICATIONS

Van Zuilekom and Rourke, "Hostile Formation Testing Advances and Lessons Learned," Society of Petroleum Engineers (SPE) 124048, SPE Annual Technical Conference and Exhibition held in New Orleans, Louisiana, USA, Oct. 4-7, 2009.

(Continued)

*Primary Examiner* — John Fitzgerald
(74) *Attorney, Agent, or Firm* — Stephanie Chi; Jody DeStefanis

(57) ABSTRACT

Techniques for determining at least one downhole parameter of a wellsite are provided. A sensor apparatus is operatively connectable to a downhole tool deployable into a borehole of the wellsite, the downhole tool having a conduit system for receiving downhole fluid. The sensor apparatus has a housing, at least one gauge, a gauge carrying body positionable in the housing for receiving the gauge, and a flowline extending through the gauge carrying body for operatively connecting the conduit system to the gauge whereby parameters of the downhole fluid are measured. The gauge has at least one pressure sensor and at least one temperature sensor. The gauge carrying body has a pressure resistant block and a thermal absorber positionable about the gauge.

27 Claims, 5 Drawing Sheets

(56) References Cited

U.S. PATENT DOCUMENTS

| | | | | |
|---|---|---|---|---|
| 5,471,882 | A * | 12/1995 | Wiggins | 73/702 |
| 5,578,759 | A * | 11/1996 | Clayton | 73/702 |
| 6,111,340 | A | 8/2000 | Sinha et al. | |
| 6,147,437 | A | 11/2000 | Matsumoto et al. | |
| 6,336,408 | B1 | 1/2002 | Parrott et al. | |
| 6,341,498 | B1 | 1/2002 | DiFoggio | |
| 6,427,530 | B1 | 8/2002 | Krueger et al. | |
| 6,455,985 | B1 * | 9/2002 | Matsumoto | 310/338 |
| 6,655,458 | B2 | 12/2003 | Kurkjian et al. | |
| 6,672,093 | B2 | 1/2004 | DiFoggio | |
| 6,729,399 | B2 | 5/2004 | Follini et al. | |
| 6,769,296 | B2 | 8/2004 | Montalvo et al. | |
| 6,769,487 | B2 | 8/2004 | Hache | |
| 6,877,332 | B2 | 4/2005 | DiFoggio | |
| 7,017,662 | B2 | 3/2006 | Schultz et al. | |
| 7,024,930 | B2 | 4/2006 | Follini et al. | |
| 7,036,579 | B2 | 5/2006 | Follini et al. | |
| 7,117,734 | B2 | 10/2006 | Follini et al. | |
| 7,124,596 | B2 | 10/2006 | DiFoggio et al. | |
| 7,147,437 | B2 | 12/2006 | Burdgick et al. | |
| 7,210,344 | B2 | 5/2007 | Follini et al. | |
| 7,246,940 | B2 | 7/2007 | Storm et al. | |
| 7,258,169 | B2 | 8/2007 | Fripp et al. | |
| 7,263,880 | B2 | 9/2007 | Pop et al. | |
| 7,268,019 | B2 | 9/2007 | Golla et al. | |
| 7,290,443 | B2 | 11/2007 | Follini et al. | |
| 7,301,223 | B2 | 11/2007 | Rodney et al. | |
| 7,363,971 | B2 | 4/2008 | Rodney et al. | |
| 7,423,258 | B2 | 9/2008 | DiFoggio et al. | |
| 7,540,165 | B2 | 6/2009 | DiFoggio et al. | |
| 7,568,521 | B2 | 8/2009 | Brown et al. | |
| 7,571,770 | B2 | 8/2009 | DiFoggio et al. | |
| 7,647,979 | B2 | 1/2010 | Shipley et al. | |
| 7,699,102 | B2 | 4/2010 | Storm et al. | |
| 2003/0053516 | A1 * | 3/2003 | Atherton | 374/143 |
| 2006/0086506 | A1 | 4/2006 | Golla et al. | |
| 2006/0101831 | A1 | 5/2006 | Storm et al. | |
| 2006/0102353 | A1 | 5/2006 | Storm et al. | |
| 2006/0191682 | A1 | 8/2006 | Storm et al. | |
| 2008/0277162 | A1 | 11/2008 | DiFoggio | |
| 2009/0045814 | A1 | 2/2009 | Csutak | |
| 2009/0128144 | A1 | 5/2009 | Freedman et al. | |

OTHER PUBLICATIONS

Quartzdyne, Inc., "Operating Manual for Quartzdyne® Digital Pressure Transducer," Nov. 2009.

Quartzdyne, Inc., "Differential Pressure (Dt p) Measurements Using a Quartzdyne Transducer," Aug. 2001.

Roger W. Ward & Robert B. Wiggins, "Quartz Pressure Transducer Technologies," 1997.

Quartzdyne, "Performance Reliability Ruggedness—Quartz", Dec. 2, 2011.

Quartzdyne, "Performance Reliability Ruggedness—Quartz Downhole Pressure Transducers", Dec. 2, 2011.

Quartzdyne, "Performance Reliability Ruggedness—Logging", Dec. 2, 2011.

* cited by examiner

APPARATUS, SYSTEM AND METHOD FOR DETERMINING AT LEAST ONE DOWNHOLE PARAMETER OF A WELLSITE

RELATED APPLICATIONS

This application claims the benefit of U.S. Provisional Application No. 61/450,168, filed Mar. 8, 2011, the entire disclosure of which application is incorporated herein by reference.

BACKGROUND OF THE INVENTION

1. Field of the Invention

The present invention relates to techniques for performing wellsite operations. More particularly, the present invention relates to techniques for determining parameters, such as pressure, of downhole fluids and/or formations.

2. Background of the Related Art

Oilfield operations are typically performed to locate and gather valuable downhole fluids. Typical oilfield operations may include, for example, surveying, drilling, reservoir testing, completions, production, planning, oilfield analysis, fluid injection, fluid storage and abandonment. During such operations, it may be desirable to perform various evaluations (e.g., testing and/or sampling) of downhole parameters. Downhole tools, such as drilling and/or wireline tools, may be provided with devices to perform downhole evaluations of the wellbore and the surrounding formation. Such evaluations may involve the measurement of downhole fluids, such as borehole and/or formation fluids.

Downhole evaluation may require that formation fluid be drawn into the downhole tool for testing and/or sampling. Various fluid communication devices, such as probes, may be extended from the downhole tool to establish fluid communication with the formation and/or surrounding wellbore, and to draw fluid into the downhole tool. A typical probe may extend from the downhole tool and be positioned against the sidewall of the wellbore. A rubber packer at the end of the probe may be used to create a seal with the wellbore wall. Another device used to form a seal with the wellbore wall is referred to as a dual packer. With a dual packer, two elastomeric rings expand radially about the tool to isolate a portion of the wellbore therebetween. The rings may be used to form a seal with the wellbore wall, and permit fluid to be drawn into the isolated portion of the wellbore and into an inlet in the downhole tool.

The downhole tool may draw downhole and/or formation fluids into the downhole tool for testing by one or more sensors within the downhole tool. The sensors may test for various downhole properties, such as pressure and temperature of the downhole fluids. The sensors may be, for example, piezoelectric pressure and temperature transducers. Such transducers may each comprise a crystal resonator located inside a housing structure for the pressure transducer and the temperature transducer. One or more of the sensors may be exposed to borehole fluids for measurement thereof, or isolated therefrom. The sensors may be exposed to harsh conditions, such as extreme temperatures and/or pressures that may affect their quality of measurement.

Electrodes may be placed on opposite sides of each of the resonators (e.g., pressure and temperature) to provide a vibration-exciting field in the resonator. Environmental pressure and temperature may be transmitted to each of the two resonators via the housing and the stresses in the resonator may alter the vibrational characteristics of the resonator. Each of the resonators may be a unitary piezoelectric crystal resonator having a common housing structure in which the resonator is positioned on a median (radial) plane of the cylindrical housing. Crystal end caps may be located at either end of the housing to complete the structure of the transducer. Since the vibration of the resonators may be affected by both temperature and pressure, such devices can be difficult to use in environments where both vary in an uncontrolled manner. Such devices are sometimes referred to as single mode transducers.

Attempts have been made to measure certain downhole parameters as described, for example, in U.S. Pat. Nos. 7,647,979; 7,571,770; 7,568,521; 7,540,165; 7,423,258; 7,363,971; 7,301,223; 7,290,443; 7,268,019; 7,263,880; 7,258,169; 7,246,940; 7,210,344; 7,124,596; 7,117,734; 7,036,579; 7,024,930; 7,017662; 6,877,332; 6,769,296; 6,729,399; 6,672,093; 6,655,458; 6,341,498; 6,147,437; 6,111,340; 5,302,879; 5,265,677; 5,221,873; 4,936,147; 4,802,370; 4,607,530; 4,547,691; 4,407,136; 3,617,780; 2009/0128144; 2009/0045814; 2008/0277162; 2006/0102353; 2006/0101831; 2006/0086506 and in International Patent/Application Nos. WO2006/065559; WO2006/060673; WO2002/037072 and EP552884. In some cases, techniques have been developed for performing downhole evaluations in high temperature and/or hostile environments as described, for example in U.S. Pat. Nos. 7,568,521; 6,336,408; 6,769,487 and in Van Zuilekom and Rourke, "Hostile Formation Testing Advances and Lessons Learned," Society of Petroleum Engineers (SPE) 124048, SPE Annual Technical Conference and Exhibition held in New Orleans, La., USA, 4-7 Oct. 2009.

Despite the development of techniques for measuring downhole parameters, there remains a need to provide advanced techniques for determining parameters of downhole formations and/or wellbore fluids. The present invention is directed at fulfilling such need.

SUMMARY OF THE INVENTION

In at least one aspect, the invention relates to a sensor apparatus for determining at least one downhole parameter of a wellsite. The sensor apparatus is operatively connectable to a downhole tool deployable into a borehole of the wellsite. The downhole tool has a conduit system for receiving downhole fluid. The sensor apparatus includes a housing, at least one gauge, a gauge carrying body positionable in the housing for receiving the gauge, and a flowline extending through the gauge carrying body for operatively connecting the conduit system to the gauge whereby parameters of the downhole fluid are measured. The gauge has at least one pressure sensor and at least one temperature sensor. The gauge carrying body has a pressure resistant block and a thermal absorber positionable about the gauge.

The thermal absorber may be made of copper. The sensor apparatus may further have at least one insulator (e.g., an axial insulator) made of thermal insulation. The insulator may be positioned upstream and/or downstream of the gauge.

The gauge may also have a reference sensor. The pressure and temperature sensors may be quartz crystals. The housing may have an inner wall, an outer wall with an insulating space therebetween. At least one of the inner and outer walls may be made of a pressure resistant material. The insulating space may be a void or have insulation therein. The housing may have at least one void manifold. The sensor apparatus may also have a thermal stabilization system for thermally stabilizing the gauge. The thermal stabilizing system may include thermal regulating elements, temperature gradient monitoring electronics, thermal regulating electronics and a controller. The flowline may have an inner diameter of less than 5 mm. A temperature gradient about the gauge may be stabilized to less than 1° C./25 mm.

In another aspect, the invention may relate to a sensor system for determining at least one downhole parameter of a wellsite. The sensor system may include a downhole tool deployable into a borehole of the wellsite (the downhole tool having a conduit system for receiving downhole fluid) and a sensor apparatus operatively connectable to the downhole tool. The sensor apparatus includes a housing, at least one gauge, a gauge carrying body positionable in the housing for receiving the gauge, and a flowline extending through the gauge carrying body for operatively connecting the conduit system to the gauge whereby parameters of the downhole fluid are measured. The gauge has at least one pressure sensor and at least one temperature sensor. The gauge carrying body has a pressure resistant block and a thermal absorber positionable about the gauge.

The sensor system may include an electronics component, a sampling component and/or a probe component positionable in the downhole tool. The housing may extend over at least a portion of the electronics component. An insulator may be provided between the electronics component and the gauge and/or between the probe component and the gauge.

In yet another aspect, the invention may relate to a method for determining at least one downhole parameter of a wellsite. The method may involve operatively connecting a sensor apparatus to a downhole tool, deploying the downhole tool into a borehole of the wellsite, receiving a downhole fluid into the downhole tool via a conduit system, passing fluid from the conduit system to the gauge via the flowline, and measuring at least one parameter of the downhole fluid with the gauge. The measuring at least one parameter may involve determining a pressure. The method may further involve activating a thermal stabilization system to adjust a temperature about the gauge.

BRIEF DESCRIPTION OF THE DRAWINGS

The present embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION OF THE INVENTION

The description that follows includes exemplary apparatus, methods, techniques, and instruction sequences that embody techniques of the inventive subject matter. However, it is understood that the described embodiments may be practiced without these specific details. Various gauges, sensors, crystals and/or other measuring devices are described herein. For clarity, a device hosting individual sensors/crystals will be referred to as a gauge.

It may be desirable to provide techniques that enhance downhole evaluation, preferably while protecting the evaluation mechanisms (e.g., temperature and/or pressure sensors). It may be further desirable to provide techniques that isolate the measurements, preferably, such that interference with other measurements is eliminated. Such techniques may involve one or more of the following, among others: enhanced accuracy of measurements, optimized measurement processes, real time capabilities, compatibility with existing wellsite equipment, operability in downhole conditions (e.g., at high temperatures and/or pressures), etc. The present invention is configured to provide such techniques.

Figure 1:
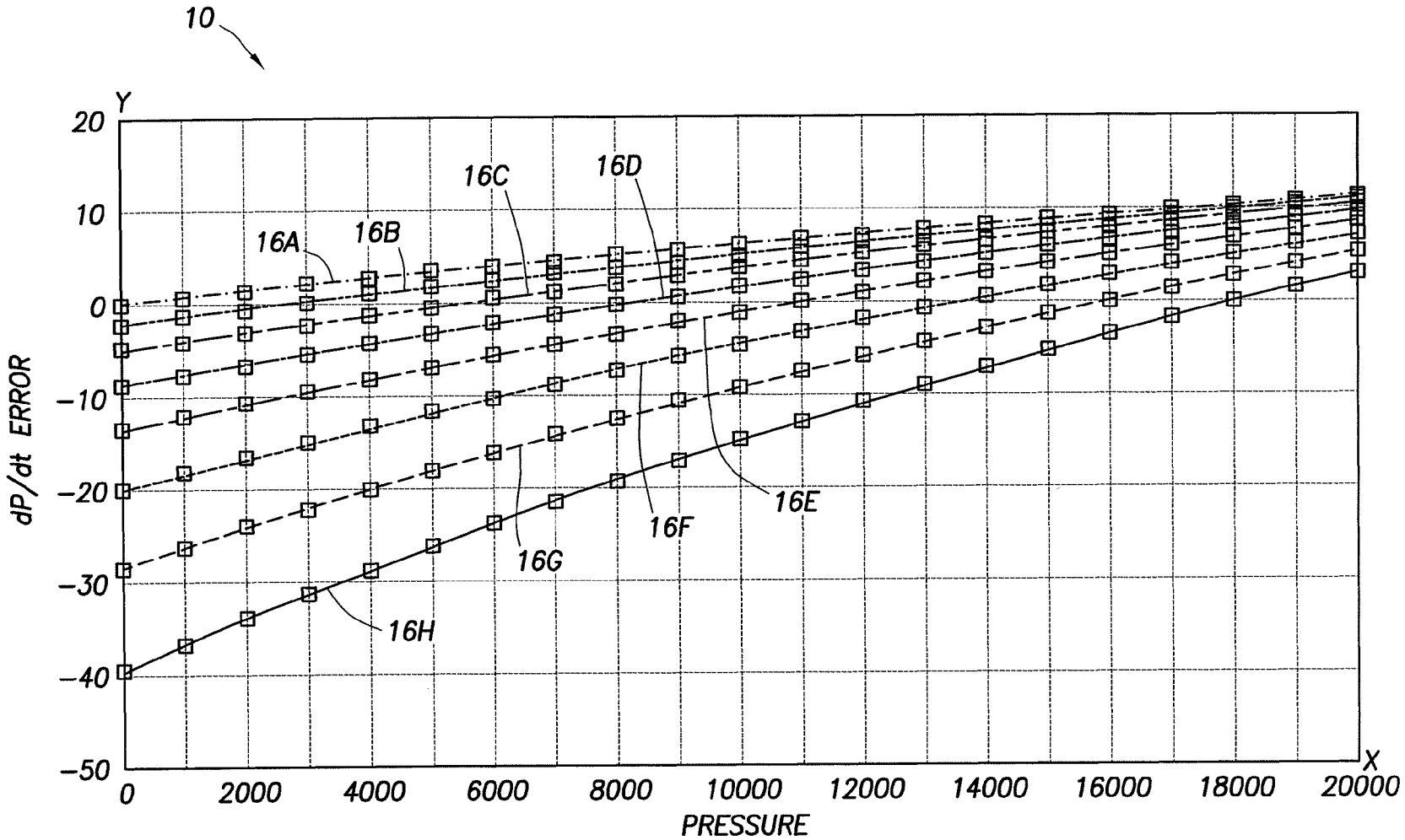
FIG. 1 is a graph depicting sensitivity of a sensor.

FIG. 1 is a graph 10 illustrating the sensitivity (or measurement error) of a gauge when exposed to various temperatures. The gauge may be, for example, the gauge 112 in the downhole tool 104 of FIG. 2 with a pressure sensor (or crystal) 112A for measuring pressure and a temperature sensor (or crystal) 112B for measuring temperature as will be described further herein.

As indicated by graph 10, a gauge with at least two crystals may be sensitive to thermal gradients along the gauge. As also indicated by the graph 10, this sensitivity may increase at higher temperatures, with a measurement error (dP/dt) being proportional to the temperature difference between the crystals. This relationship may be demonstrated by Equation (1) below:

$$T(\text{Temperature Crystal})-T(\text{Pressure Crystal})=\pm 1\text{ deg C.}\Rightarrow dP/dt \qquad \text{Eqn. (1)}$$

This Equation indicates that a temperature difference of one (1) degree Celsius between the temperature crystal (T(Temperature Crystal)) and pressure crystal (T(Pressure Crystal)) leads to error in the pressure measurement (dP/dt). This error by the pressure crystal may not be compensated for by the temperature crystal.

The graph 10 displays example readings taken by pressure and temperature crystals at given pressures and temperatures, together with their resulting error (dP/dt). In the graph 10, the sensitivity is shown as dP/dt Error along the Y-axis, and the pressure is shown along the X-axis. The error (dP/dt) may be the pressure error (dP/dt) per 1° C. temperature difference between the temperature and pressure crystals. Lines 16A-H represent the error as a function of pressure where the crystals are exposed to 25° C., 50° C., 75° C., 100° C., 125° C., 150° C., 175° C., and 200° C., respectively.

This graph 10 suggests that, as the temperature affecting the crystals increases, the error (dP/dt) increases. For example as indicated by line 16H, for crystals reaching 200° C., a 1° C. temperature differential may create a 34 psi (234.42 KPa) error at 2000 psi (137,789.51 KPa). While at an ambient pressure, for the crystals reaching 200° C., a 1° C. temperature differential may create a 40 psi (275.79 Kpa) error. As shown in the graph 10 at lines 16A-C, if the crystals remain below 100° C., the error may be 10 psi (68.95 Kpa), or lower.

Based on graph 10, it may be desirable to keep the crystals below a given temperature to prevent increased error. It may, however, be necessary to use gauges and/or crystals in places with extreme temperatures, such as in downhole environments. In such cases, the gauge and/or crystals may be allowed to cool, equalize and/or stabilize over time before performing the desired measurement. This may take some time and/or cause significant downtime during wellsite operations.

Figure 2:
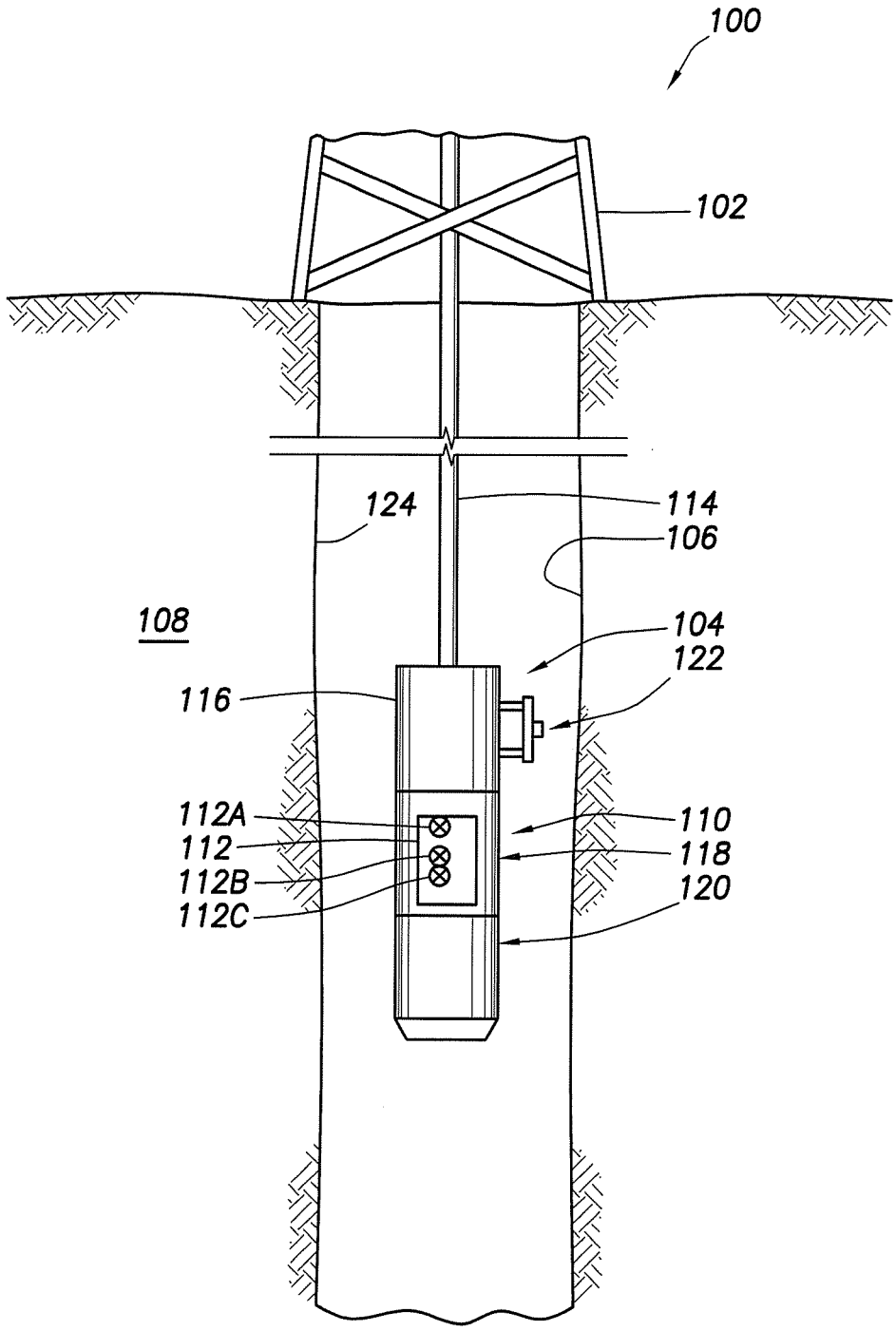
FIG. 2 is a schematic diagram of a wellsite having a downhole tool with a sensor apparatus in accordance with the invention.

In another example, the gauge and/or crystals may be thermally stabilized (and/or thermally isolated) from heat sources, such as harsh wellbore conditions, electronics, etc. Thermally stabilized environments may be used to keep the gauge at a lower temperature, such as an installation temperature. The thermally stabilized environment may be at a temperature that is less than a downhole temperature of the downhole environment. For example, when the downhole environment has a temperature of over 180° C., the downhole tool 104 (as shown in FIG. 2) may be placed within the downhole environment while maintaining the environment of the gauge at a much lower temperature than 180° C. Where the gauge temperature remains relatively constant, there may be no downtime necessary to allow the temperature gradient in the downhole tool to subside. In some applications, the temperature of the environment may need to be increased. Thus, thermal stabilization may require an increase or a decrease in temperature, depending on the desired temperature.

FIG. 2 is a schematic view of a wellsite 100 having an oil rig 102 with a downhole tool 104 suspended into a wellbore 106 therebelow. The wellbore 106 may be formed through one or more subterranean formations 108. The wellbore 106 has been drilled by a drilling tool (not shown). A drilling mud, and/or a wellbore fluid, may have been pumped into the wellbore 106 and may line a wall 124 thereof. As shown, the oil rig 102 is a land based rig; however, it may be a sea-based oil rig.

The downhole tool 104 may have a sensor apparatus 110 therein. The sensor apparatus 110 is preferably thermally stabilized for protection from high temperatures and/or pressures that may result from exposure to downhole conditions and/or other downhole components. The sensor apparatus 110 preferably has a gauge 112 for performing downhole evaluations, such as measuring a condition in the wellsite 100. The gauge 112 is preferably provided with protection, such as stabilizers, barriers and insulators as will be described further herein. Such protection may involve, for example, isolation from exposure to pressure, temperature, etc. Preferably, the gauge 112 is thermally stabilized to alleviate errors that may result from, for example, high temperatures in the wellsite environment.

The gauge 112 may be provided with one or more sensors (or crystals) 112A, 112B, 112C for taking individual or combined measurements, such as pressure, temperature, etc. The gauge 112 may be provided with, for example, a conventional pressure transducer 112A, a temperature sensor 112B, and a reference sensor 112C. Examples of downhole gauges, crystals and/or sensors are commercially available from QUARTZDYNE™, Inc. at 4334 West Links Drive, Salt Lake City, Utah 84120, USA, and described in U.S. Pat. Nos. 4,547,692, 4,607,530, 6,111,340, and 7147437.

The wellsite environment may have a thermal gradient along the wellbore 106, that may increase and/or decrease in temperature. As schematically shown, the sensor apparatus 110 is located about the downhole tool 104. One or more gauges 112 and/or sensor apparatuses 110 may be positioned at various locations about the downhole tool 104.

The downhole tool 104 as shown is a wireline tool suspended from a wireline 114. Although the downhole tool 104 is shown as being conveyed into the wellbore 106 on the wireline 114 it may be conveyed by any suitable method such as a coiled tubing, a slickline, a conventional tubing and the like. The downhole tool 104 may also be located on other downhole equipment, such as drill collars, drilling tools, and the like. Thus, the downhole tool 104 may be any suitable tool capable of performing wellbore and/or formation evaluation and may be a part of any downhole tool, such as a logging tool, a wireline tool, a drilling tool, a casing drilling tool, a completions tool, a coiled tubing tool, a bottom hole assembly (BHA), a robotic tractor, or other downhole tool and/or system. Additionally, the downhole tool 104 may have alternate configurations, such as modular, unitary, autonomous and other variations of downhole tools.

Figure 3B:
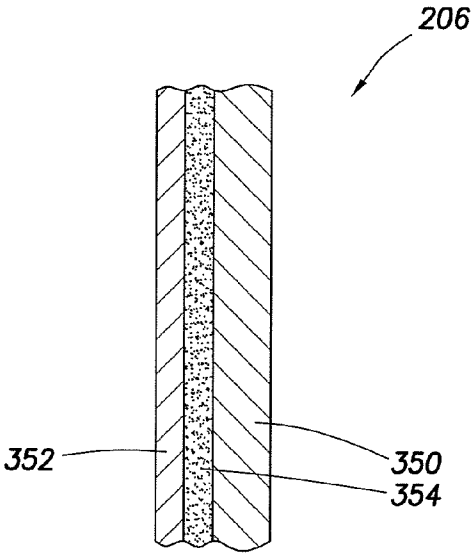
FIG. 3B is a detailed view of a portion 3B of the downhole tool of FIG. 3A.
Figure 3A:
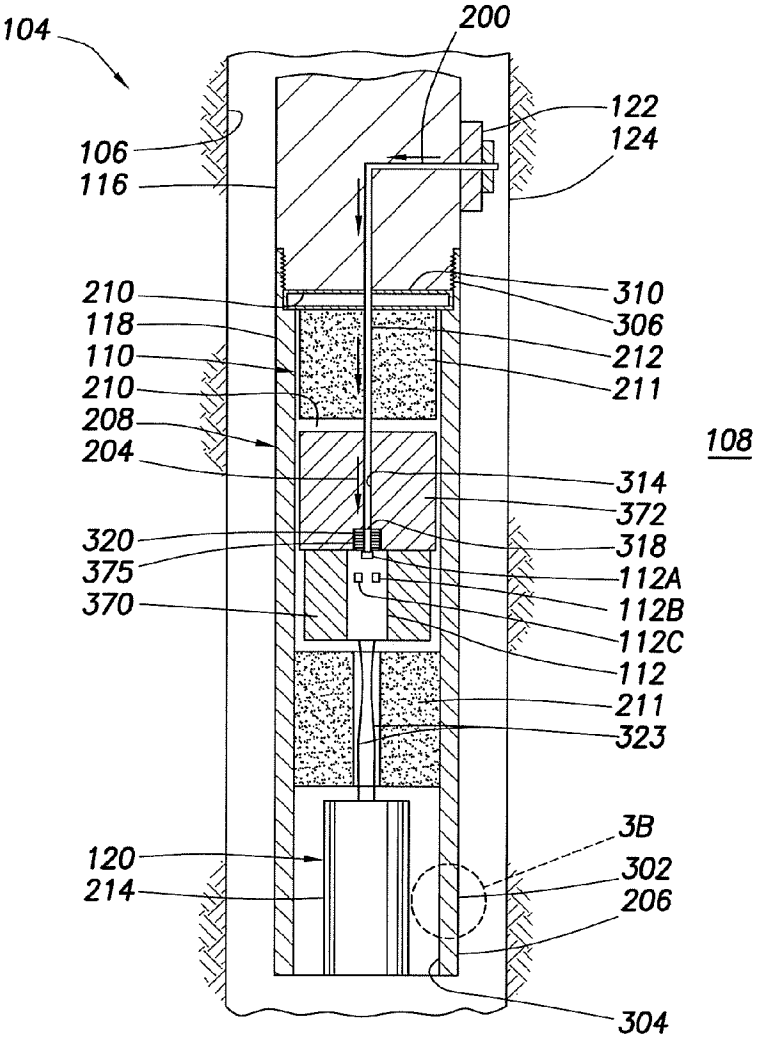
FIG. 3A is an alternate schematic view, partially in cross-section, of the downhole tool of FIG. 2.

FIG. 3A shows an alternate schematic view, partially in cross-section of the downhole tool 104 of FIG. 2. As shown in FIGS. 2 and 3A, the downhole tool 104 may have one or more components, or modules configured to collect, test, manipulate, control, send and/or receive information about the wellsite 100. The downhole tool 104 has a probe component 116 and/or a dual packer (not shown), a sample component 118 and an electronics component 120. The probe component 116 may have various devices configured to take a sample from the wellbore 106 and/or the subterranean formation 108 and deliver the sample, or a portion thereof, to the sample component 118. The probe component 116 may be any suitable device or system to assist in taking and delivering the sample. The probe component 116 may have a probe assembly 122, a conduit system 200, a sample chamber (not shown), and the like.

The probe assembly 122 may be any suitable probe for establishing fluid communication with and for taking a fluid sample from the wellbore 106 and/or the subterranean formation 108. The probe assembly 122 may be extendable from the downhole tool 104 for engagement with the wall 124 of the wellbore 106. The probe assembly 122 may be operatively coupled to, and/or in fluid communication with the conduit system 200 for drawing fluid into the downhole tool 104 and/or to the sample component 118. Although the probe component 116 is shown as having a probe assembly 122 for obtaining samples, it will be appreciated that any suitable system for obtaining samples may be used, such as dual packers. As shown in FIG. 3A, the probe component 116 collects a sample 204 through the probe assembly 122. The conduit system 200 may then deliver the sample 204 (or a portion thereof) to the sample component 118 of the downhole tool 104.

The conduit system 200 is shown schematically as passing samples from the formation 108 and/or the wellbore 106 to the sample component 118 as indicated by the arrows. The conduit system 200 may have other paths not depicted, such as a path from the probe assembly 122 to an exit port (not shown), to another sensor device, and the like. The conduit system 200 may have any suitable components to assist in the procuring and moving of the samples from the wellbore 106 and/or formation 108 to the sample component 118, such as valves, one or more flowlines, restrictors, sensors, gauges, monitors, and the like.

The sample component 118, as shown in FIG. 3A, has the sensor apparatus 110. The sensor apparatus 110 may have the gauge 112 located at least partially within a housing (or thermal insulator) 206. The housing 206 may substantially insulate the gauge 112 from the temperatures in the wellbore 106 and/or the formation 108. In addition to the housing 206, the sensor apparatus 110 may have other insulating features that provide a thermally stabilized environment for the gauge 112, such as, but not limited to, a gauge carrying body 208 (or insulating or thermal block), void spaces 210, a phase change material (not shown), one or more flowlines (or flow tubes) 212, and/or axial insulators 211.

The sample component 118 and/or the sensor apparatus 110 may be in communication with the electronics component 120. The electronics component 120 may have electronics 214 suitable for operating the sensor apparatus 110, operating other components in the downhole tool 104, and/or sending and receiving data about the wellsite 100. The electronics component 120 may be any device capable of housing or supporting the electronics 214 disposed therein. While some electronics may be dispersed throughout the downhole tool 104, the electronics are preferably consolidated into a single portion of the downhole tool 104, or a single module. The electronics 214 may have any suitable electronic devices and/or components such as sources, sensors, electrodes, and the like. Such electronics 214 may be used to activate such devices and/or components to perform various functions, such as telemetry, sampling, evaluation and/or other downhole operations.

The housing 206 of FIG. 3A (and the detailed view in FIG. 3B) is depicted as a housing 206 surrounding the gauge 112 and the electronics 214 (and other portions of the downhole tool 104). The housing 206 may be positioned within the downhole tool 104 and/or be integral with a housing of the downhole tool 104. The housing 206 may be a cylindrical shape that is configured to house the gauge 112. Although, the housing 206 is shown as having a cylindrical shape, the housing 206 may have any suitable shape for containing the sensor 112 and/or the electronics 214. The housing 206 may extend past the electronics component 120 in order to substantially thermally isolate the electronics 214. Further, the housing 206 may surround the sensor apparatus 110, the gauge 112 and/or the electronics component 120, thereby enclosing such items completely within the housing 206.

An outer surface 302 of the housing 206 may be exposed to a downhole environment having high temperatures and/or pressures. The housing 206 may be constructed as an insulator housing 206 in order to prevent the high wellbore temperatures from heating up the gauge 112 and electronics 120 within the housing 206. The insulator housing 206 may be constructed, or made, of a material that substantially prevents heat transfer from the outer surface 302 of the housing 206 to the inner surface 304 of the housing 206. The heat transfer prevention may be achieved by making the housing 206, for example a flask, or a Dewar flask.

FIG. 3B is a schematic, detailed portion 3B of the housing 206 of FIG. 3A. In this version as shown, the housing is a flask. The housing 206, or flask, may have an outer wall 350 and an inner wall (or sleeve) 352 separated by insulation 354. The insulation 354 may substantially prevent heat transfer between the outer wall 350 and the inner wall 352. The insulation 354 may be a housing space with an empty vacuum therein.

The insulation 354 may be filled, or partially filled, with an insulation material to further prevent heat transfer between the outer wall 350 and the inner wall 352. The insulation 354 may be any suitable insulation material such as a fiberglass, a plastic, phase change material, vacuum and the like. The outer wall 350 and the inner wall 352 may be constructed to limit heat transfer between the surfaces while resisting the pressure and temperature conditions outside the downhole tool. For example, the outer wall 350 and the inner wall 352 of the housing 206 may be made of INCONEL™. Although the housing 206 is shown as a flask in FIG. 3B, the housing 206 may be a housing that controls heat transfer in a form other than a flask. Thus, the housing 206 may be constructed in any form that limits heat transfer.

As shown in FIG. 3A, the housing 206 may connect directly to the probe component 116 of the downhole tool 104. The housing 206 may have a connection (e.g., threaded) 306 configured to thread to opposing threads on the probe component 116. While the housing 206 is depicted as being connected to the probe component 116 with a threaded connection, any device for coupling the housing 206 to the probe component 116 may be used, such as welding the components together, bolting, screwing and the like.

To prevent thermal transfer from the probe component 116 to the gauge 112 there may be one or more void spaces 210 within the housing 206. As shown in FIG. 3A, there are two void spaces 210 between the probe component 116 and the gauge 112. The void spaces 210 may be at various locations of the housing 206, with the one or more flow tubes 212 running therethrough. In some cases, the void spaces 210 between two components within the housing 206 may have only the flow tubes 212 positioned therein.

As shown in FIG. 3A, the void space 210 closest to the probe component 116 is a space within the housing 206, and between the probe component 116 and the axial insulator 211. The void space 210 may optionally be placed under vacuum. The void space 210 closest to the gauge 112 may be a space within the housing 206 and located adjacent components of the sensor, such as the axial insulator(s) 211. The void space 210 may be sealed when the downhole tool 104 is assembled. Thus, the void spaces 210 may be at atmospheric temperature and/or pressure when the downhole tool 104 is assembled at the surface. The void space 210 may be adapted to substantially block heat transfer between the probe component 116 and the gauge 112 by not allowing the heat to travel through a conductor within the housing 206.

Each of the void spaces 210 may have a void manifold 310. The void manifold 310 may be a manifold configured to couple to the interior of the housing 206. The void manifold 310 may surround, define and/or seal the void space 210. The void manifold 310 may be, for example, a cylindrical manifold having one or more connectors (not shown) for coupling the void manifold to the inner surface 304 of the housing 206. However, the void manifold 310 may have any suitable configuration for defining, and/or insulating with the void space 210 and securing to the housing 206. The void space 210 may be filled and/or partially filled with insulation. The insulation may be any suitable insulation such as those described herein.

The gauge carrying body 208 (or thermal mass or block) may be any suitable mass configured to further prevent heat transfer within the housing 206 of the sample component 118. As shown in FIG. 3A, the gauge carrying body 208 may be one or more insulator masses located between the axial insulators 211 in the sample component 118. The gauge carrying body 208 may be used to protect the gauge 112 within the housing 206 from temperatures that may be received from, for example, the probe component 116 and/or electronics component 120 to the gauge 112. One or more barriers, stabilizers and/or insulators may be provided using any suitable material to substantially prevent heat transfer to the gauge 112.

The gauge carrying body 208 may comprise a pressure resistant body 372 and/or a thermal absorber (or stabilizer) 370. The thermal absorber 370 may be a block, and/or plate within the housing 206 configured to act as a barrier to substantially prevent heat transfer through the thermal absorber 370. The thermal absorber 370 may have a channel therethrough configured to receive the gauge 112. The thermal absorber 370 may be made of a material that conducts heat, thereby absorbing the heat within the housing 206 from the gauge 112. The absorption of the heat by the thermal absorber 370 may control the evolution of temperature in the housing 206 during the downhole operation. For example, the thermal absorber 370 may be made of copper, a barium copper, and the like.

The pressure resistant body 372 may be any suitable body, or mass, within the housing 206 for acting as a barrier to prevent pressure (and optionally temperature) from affecting the gauge 112 outside of the flow tubes 212. The pressure resistant body 372 may be a part of the gauge carrying body 208 and/or the thermal absorber 370. The pressure resistant body 372 may be constructed of any suitable material for preventing pressure, such as an INCONEL™, a stainless steel, a metal and the like.

The gauge carrying body 208 may be provided to prevent heat transfer while facilitating pressure transfer from the probe component 116 to the gauge 112 within the housing 206. Further, the gauge carrying body 208 may have one or more sensor ports 318. The sensor ports 318 may be sized to secure the gauge 112 to the gauge carrying body 208. For example, as shown in FIG. 3A, the sensor ports 318 are cavities in the gauge carrying body 208 that the gauge 112 may substantially fit within. There may be one or more sensor connectors 320 that secure the installed gauge 112 within the sensor ports 318. The sensor connectors 320 may be any suitable connector for coupling the gauge 112 to the gauge carrying body 208.

The axial insulators 211 and/or the gauge carrying body 208 may have one or more flow tube ports 314 that pass therethrough. The one or more flow tube ports 314 may be sized to pass each of the one or more flow tubes 212 through the axial insulators 211 and/or the gauge carrying body 208. The one or more flow tube ports 314 may be sized to snuggly fit the flow tubes 212 with the one or more flow tube ports 314 for substantially preventing the heat from transferring between the flow tubes 212 and the one or more flow tube ports 314. Further, the one or more flow tubes 212 may be integral with the one or more flow tube ports 314. The one or more flow tube ports 314 in the gauge carrying body 208 are in communication with the sensor ports 318 for allowing the gauge 112 to be operatively coupled with the flow tubes 212.

The flow tubes 212 and/or the one or more flow tube ports 314 may communicatively couple the probe assembly 122 to the gauge 112. The flow tubes 212 may allow one or more samples and/or conditions in the wellbore 106 and/or formation 108, to be transferred to the gauge 112 for analysis.

The flow tubes 212 may be sized to allow pressure from the wellbore 106 and/or formation 108 to travel through the flow tubes 212. The flow tubes 212 may further be sized to substantially prevent heat transfer to the gauge 112. For example, an inner diameter of the flow tubes 212 may be small, thereby preventing a substantial amount of heat to transfer through the flow tube 212 while still allowing pressure to transfer through the flow tube 212. In one example, the inner diameter of the flow tubes may be below about 5 mm. In another example, the inner diameter is between about 1 mm and about 4 mm. In yet another example, the inner diameter is between about 2 mm and about 3 mm. The size of the flow tubes 212 may ensure that the gauge 112 is properly thermally isolated, or at least heats homogeneously. The gauge 112 may include one or more sensors, such as sensors 112A, 112B, 112C for measuring one or more downhole parameters. The sensors 112A, 112B and/or 112C may be single mode transducers and/or quartz crystal gauges. As shown, the flow tube 212 is fluidly coupled with the quartz sensor (or crystal) 112A.

The quartz sensor 112A may comprise a crystal resonator inside a housing structure. Electrodes may be placed on opposite sides of the crystal resonator to provide a vibration-exciting field in the crystal resonator. As the pressure changes in the flow tube 212, the pressure on the crystal resonator changes the vibrational characteristics of the crystal resonator. The sensors 112A, 112B, 112C may be coupled via wires 323 to the electronics 214 for power and communication exchange therebetween. The changes in the vibrational characteristics may be measured by the electronics 214 to determine changes in the pressure of the wellbore 106 and/or the formation 108.

The gauge 112 may also have an optional quartz reference sensor 112C. Bellows 375 may also be provided between the flow tubes 212 and the pressure sensor 112A. Although, the sensors 112A, 112B, 112C are described as a single mode transducer, any suitable sensor may be used such as a dual mode transducer, a sapphire sensor, a silicon-on-insulator, and the like.

In some cases, such as where the gauge 112 and sensors 112A and/or 112B are thermally stabilized, the pressure measurement taken by the gauge 112 and sensors 112A and/or 112B may not need to be compensated for the temperature effects of the downhole environment. Therefore, there may be no need to have the optional quartz reference sensor 112C. As discussed above, the thermally stabilized sensor system is used to place the gauge 112, sensor 112A and/or sensor 112B in the thermally stabilized environment.

The thermally stabilized environment may be created at ambient temperatures and/or pressures when the downhole tool 104 is manufactured, and/or assembled. The thermally stabilized environment may have one or more of the features discussed above to maintain the gauge 112, sensor 112A and/or sensor 112B at a desired (e.g., low) temperature when deployed downhole. For example, these features creating the thermally stabilized environment may be the housing 206 (or flask), the void space 210, the axial insulators 211, the flow tubes 212 and/or the gauge carrying body 208. Due to the configuration of the gauge 112, sensor 112A and/or sensor 112B and the thermally stabilized environment, the temperature gradient in the thermally stabilized environment may be less than 1° C./25 mm (e.g., approaching zero degrees at about 0.10° C.) in all directions from the gauge 112, sensor 112A and/or sensor 112B.

Figure 4B:
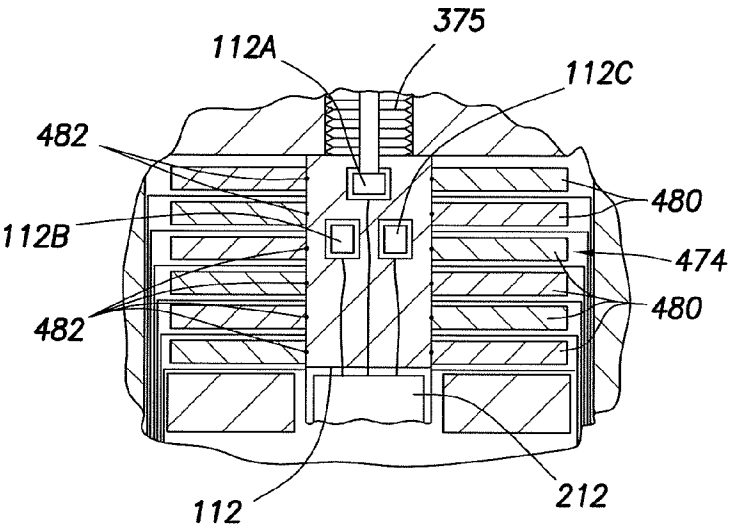
FIG. 4B is a detailed view of a portion 4B of the downhole tool of FIG. 4A.
Figure 4A:
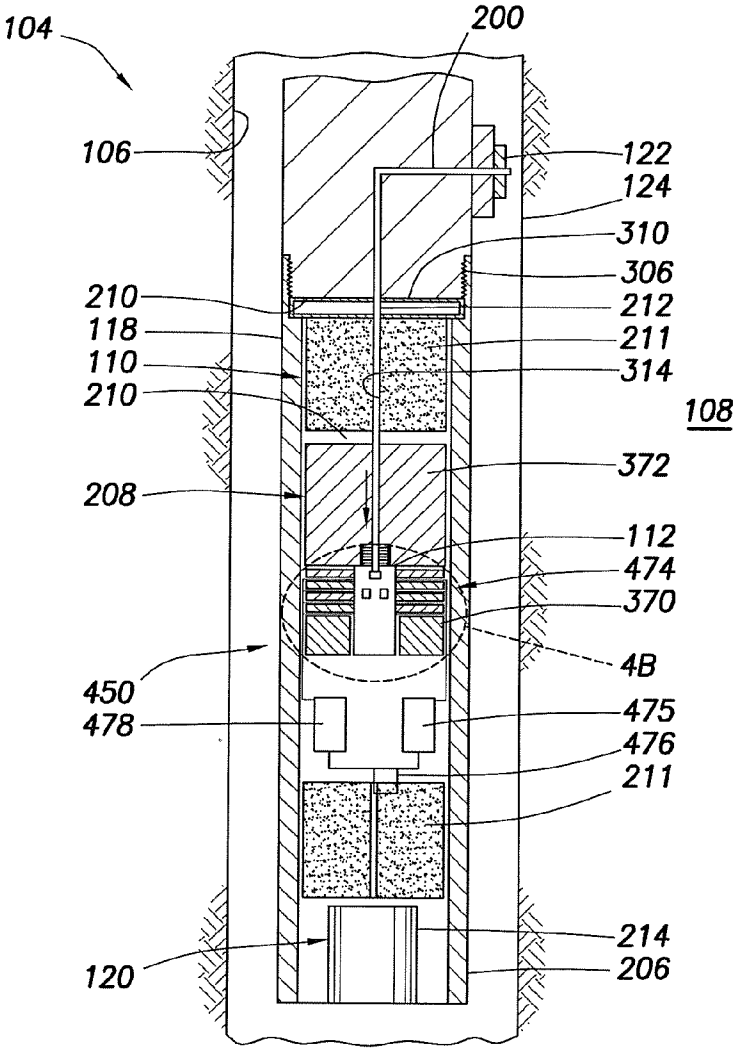
FIG. 4A is an alternate schematic view, partially in cross-section, of the downhole tool of FIG. 3A with a thermal stabilization system.

FIG. 4A is another configuration of the downhole tool 104 of FIG. 3A provided with a thermal stabilization system 450. In this configuration, the downhole tool 104 is the same as previously described in FIG. 3A, except that the thermal stabilization system 450 is positioned about gauge 112 to adjust the temperature within the housing 206. The thermal stabilization system 450 may optionally be a conventional cooling system, such as those described in U.S. Pat. Nos. 7,568,521 and 6,769,487.

FIG. 4A depicts an example of the thermal stabilizing system 450 that may be used. The thermal stabilization system 450 includes thermal regulating elements 474, thermal regulation electronics 475, a feedback/controller 476 and temperature gradient monitoring electronics 478.

FIG. 4B is a detailed view of a portion 4B of the downhole tool 104 of FIG. 4A. As shown in this view, the thermal stabilization system 450 may be provided with one or more thermal regulating elements 474 positioned about the gauge 112. The regulating elements 474 may include heating/cooling elements 480 for selectively heating/cooling. The heating/cooling elements 480 may be provided with temperature sensors 482 thereon for monitoring the temperature thereof. The temperature sensors 482 may be electrically coupled to the heating/cooling elements and temperature gradient monitoring electronics 478.

FIG. 4B also shows the sensors 112A, 112B, 112C in greater detail. As shown in this view, the bellows 375 is fluidly connected to the flow tube 212 for translating the pressure of the fluid therein to the pressure sensor 112A. Temperature sensors 112B, 112C are also provided to provide temperature measurements as desired. While a specific configuration of sensors 112A, 112B, 112C is provided, one or more sensors for measuring various parameters may be provided for measuring one or more downhole parameters.

Figure 5:
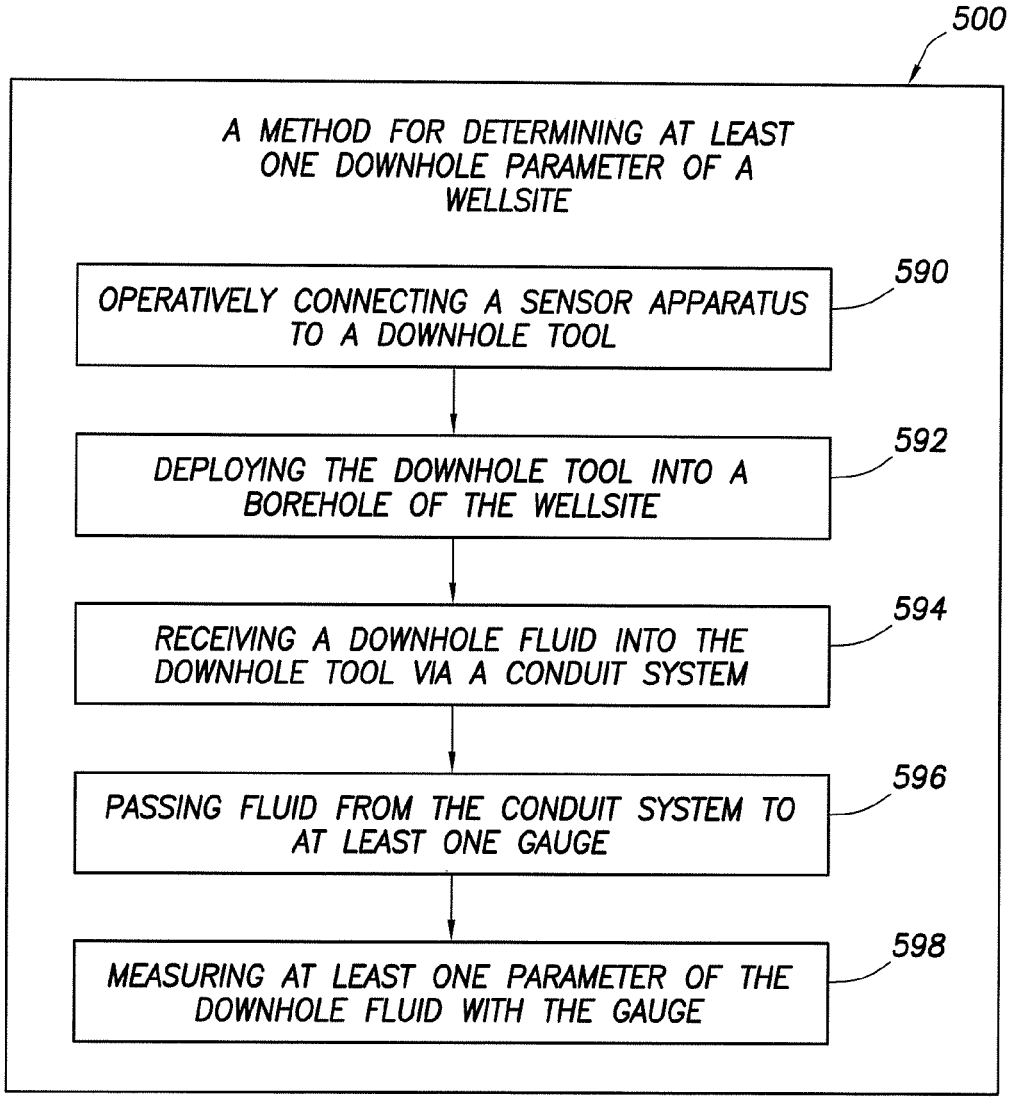
FIG. 5 is a flowchart depicting a method of detecting a downhole parameter.

FIG. 5 is a flowchart 500 depicting a method for determining at least one downhole parameter of a wellsite using, for example, the sensor apparatus 110 of FIG. 2. The method involves operatively connecting (590) a sensor apparatus, such as the sensor apparatus 110 of FIG. 2, to a downhole tool. The method further involves deploying (592) the downhole tool into a borehole of the wellsite, receiving (594) a downhole fluid into the downhole tool via a conduit system, passing (596) fluid from the conduit system to at least one gauge, and measuring (598) at least one parameter, for example temperature and/or pressure, of the downhole fluid with the gauge.

The method may further involve additional steps, such as determining at least one parameter and/or determining a pressure and activating a cooling system to cool the gauge. The steps may be performed in any order as desired.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A sensor apparatus for determining at least one downhole parameter of a wellsite, the sensor apparatus operatively connectable to a downhole tool deployable into a borehole of the wellsite, the downhole tool having a conduit system for receiving downhole fluid, the sensor apparatus comprising:

a housing;

at least one gauge, the at least one gauge comprising at least one pressure sensor and at least one temperature sensor;

a gauge carrying body positionable in the housing for receiving the at least one gauge, the gauge carrying body comprising a pressure resistant block and a thermal absorber positionable about the at least one gauge; and a flowline extending through the gauge carrying body for operatively connecting the conduit system to the at least one gauge whereby parameters of the downhole fluid are measured.

2. The sensor apparatus of claim 1, wherein the thermal absorber comprises copper.

3. The sensor apparatus of claim 1, wherein the at least one gauge further comprises a reference sensor.

4. The sensor apparatus of claim 1, wherein the pressure and temperature sensors are quartz crystals.

5. The sensor apparatus of claim 1, wherein the housing has at least one void manifold.

6. The sensor apparatus of claim 1, wherein the flowline has an inner diameter of less than 5 mm.

7. The sensor apparatus of claim 1, wherein a temperature gradient about the at least one gauge is stabilized to less than 1° C./25 mm.

8. The sensor apparatus of claim 1, further comprising at least one insulator.

9. The sensor apparatus of claim 8, wherein the at least one insulator comprises insulation.

10. The sensor apparatus of claim 8, wherein the at least one insulator is positioned upstream of the at least one gauge.

11. The sensor apparatus of claim 8, wherein the at least one insulator is positioned downstream of the at least one gauge.

12. The sensor apparatus of claim 1, wherein the housing comprises an inner wall, an outer wall with an insulating space therebetween.

13. The sensor apparatus of claim 12, wherein at least one of the inner and outer walls comprises a pressure resistant material.

14. The sensor apparatus of claim 12, wherein the insulating space comprises a void.

15. The sensor apparatus of claim 12, wherein the insulating space comprises insulation.

16. The sensor apparatus of claim 1, further comprising a thermal stabilization system for thermally stabilizing the at least one gauge.

17. The sensor apparatus of claim 16, wherein the thermal stabilization system comprises thermal regulating elements, temperature gradient monitoring electronics, thermal regulation electronics and a controller.

18. A sensor system for determining at least one downhole parameter of a wellsite, the sensor system comprising:

a downhole tool deployable into a borehole of the wellsite, the downhole tool having a conduit system for receiving downhole fluid; and a sensor apparatus operatively connectable to the downhole tool, the sensor apparatus comprising:

a housing;

at least one gauge, the at least one gauge comprising at least one pressure sensor and at least one temperature sensor;

a gauge carrying body positionable in the housing for receiving the at least one gauge, the gauge carrying body comprising a pressure resistant block and a thermal absorber positionable about the at least one gauge; and a flowline extending through the gauge carrying body for operatively connecting the conduit system to the at least one gauge whereby parameters of the downhole fluid are measured.

19. The sensor system of claim 18, further comprising a sampling component for taking samples received by the conduit system.

20. The sensor system of claim 18, further comprising an electronics component positionable in the downhole tool.

21. The sensor system of claim 20, wherein the housing extends over at least a portion of the electronics component.

22. The sensor system of claim 20, further comprising an insulator between the electronics component and the at least one gauge.

23. The sensor system of claim 18, further comprising a probe component for drawing fluid into the conduit system.

24. The sensor system of claim 23, further comprising an insulator between the probe component and the at least one gauge.

25. A method for determining at least one downhole parameter of a wellsite, comprising:

operatively connecting a sensor apparatus to a downhole tool, the sensor apparatus comprising:

a housing;

at least one gauge, the at least one gauge comprising at least one pressure sensor and at least one temperature sensor;

a gauge carrying body positionable in the housing for receiving the at least one gauge, the gauge carrying body comprising a pressure resistant block and a thermal absorber positionable about the at least one gauge; and a flowline extending through the gauge carrying body for operatively connecting the conduit system to the gauge;

deploying the downhole tool into a borehole of the wellsite;

receiving a downhole fluid into the downhole tool via a conduit system;

passing fluid from the conduit system to the at least one gauge via the flowline; and measuring at least one parameter of the downhole fluid with the at least one gauge.

26. The method of claim 25, wherein the measuring at least one parameter comprises determining a pressure.

27. The method of claim 25, further comprising activating a thermal stabilization system to adjust a temperature about the at least one gauge.

* * * * *